United States Patent [19]

Malagari, Jr.

[11] 4,000,015

[45] Dec. 28, 1976

[54] PROCESSING FOR CUBE-ON-EDGE ORIENTED SILICON STEEL USING HYDROGEN OF CONTROLLED DEW POINT

[75] Inventor: Frank A. Malagari, Jr., Freeport, Pa.

[73] Assignee: Allegheny Ludlum Industries, Inc., Pittsburgh, Pa.

[22] Filed: May 15, 1975

[21] Appl. No.: 577,571

[52] U.S. Cl. ..... 148/112; 148/31.55; 148/111

[51] Int. Cl.[2] ..... H01F 1/04

[58] Field of Search ..... 148/111, 112, 31.55, 148/113; 75/123 L

[56] References Cited

UNITED STATES PATENTS

| | | | |
|---|---|---|---|
| 3,347,718 | 10/1967 | Carpenter et al. | 148/111 |
| 3,789,647 | 2/1974 | Hamilton et al. | 148/113 |
| 3,873,381 | 3/1975 | Jackson | 148/112 |
| 3,905,842 | 9/1975 | Grenoble | 148/111 |
| 3,905,843 | 9/1975 | Fiedler | 148/111 |

*Primary Examiner*—Walter R. Satterfield
*Attorney, Agent, or Firm*—Vincent G. Gioia; Robert F. Dropkin

[57] ABSTRACT

A process for producing electromagnetic silicon steel having a cube-on-edge orientation. The process includes the steps of: preparing a melt of silicon steel containing from 0.02 to 0.06% carbon, from 0.0006 to 0.0080% boron, up to 0.0100% nitrogen and from 2.5 to 4.0% silicon; casting said steel; hot rolling said steel; cold rolling said steel; decarburizing said steel to a carbon level below 0.02% in a hydrogen-bearing atmosphere havng a dew point of from +20° F to +60° F; and final texture annealing said steel.

5 Claims, No Drawings

PROCESSING FOR CUBE-ON-EDGE ORIENTED SILICON STEEL USING HYDROGEN OF CONTROLLED DEW POINT

The present invention relates to an improvement in the manufacture of grain-oriented silicon steel.

The core loss of grain-oriented silicon steel provides a measure as to the efficiency of electromagnetic devices made from the steel. As high core losses create heat which must be dissipated, and also represent low efficiency, there is a need to lower core losses. This is particularly true at high operating inductions which are becoming more and more common with today's advanced equipment.

The present invention provides a means for decreasing the core loss of boron-bearing grain-oriented silicon steel having a cube-on-edge orientation. More specifically, it decreases the core loss of said steels by carefully controlling the dew point of the hydrogen-bearing atmosphere used to decarburize them.

It is accordingly an object of the present invention to provide an improvement in the manufacture of grain-oriented silicon steel.

In accordance with the present invention a melt of silicon steel containing from 0.02 to 0.06% carbon, from 0.0006 to 0.0080% boron, up to 0.0100% nitrogen and from 2.5 to 4.0% silicon, is subjected to the conventional steps of casting, hot rolling, one or more cold rollings, an intervening normalize when two or more cold rollings are employed, and final texture annealing; and to the improvement comprising the step of decarburizing said steel to a carbon level below 0.02% in a hydrogen-bearing atmosphere having a dew point of from +20° F to +60° F. Specific processing, as to the conventional steps, is not critical and can be in accordance with that specified in any number of publications including U.S. Pat. Nos. 2,867,557 and 3,873,381.

The hydrogen-bearing atmosphere can be one consisting essentially of hydrogen or one containing hydrogen admixed with nitrogen. A gas mixture containing 80% nitrogen and 20% hydrogen has been successfully employed. Small changes in the dew point of the hydrogen reflect substantial changes in wetness. The amount of water at +80° F is seven times greater than at +30° F (35,000 ppm versus 5,000 ppm).

The dew point is maintained between +20° F and +60° F, and preferably between +30 and +45° F. Low dew points are desirable as magnetic properties correspondingly improve therewith. However, the degree of decarburization also decreases with lower dew points, as less oxygen is available to combine with carbon. As a result dew points in excess of +20° F should be employed to insure adequate decarburization. Excessive carbon will not allow for secondary recrystallization which is responsible for proper orientation, and in turn, the steel's magnetic properties. Moreover, excessive residual carbon can cause oriented steel in a transformer to magnetically age, by promoting the formation of iron carbide.

The improvement in magnetic properties attributable to the drier atmosphere of the subject invention is not evident in boron-free steels (steels containing only residual boron). Melts consisting essentially of, by weight, 0.02 to 0.06% carbon, 0.015 to 0.11% manganese, 0.015 to 0.05% sulfur, 0.0006 to 0.0080% boron, up to 0.0100% nitrogen, 2.5 to 4.0% silicon, up to 0.5% copper, up to 0.008% aluminum, balance iron, have proven to be particularly adaptable to the subject invention. Other boron-bearing melts are disclosed in heretofore referred to U.S. Pat. No. 3,873,381 and U.S. Pat. Application Ser. No. 524,846, filed Nov. 18, 1974, now U.S. Pat. No. 3,929,522 issued Dec. 30, 1975.

The following examples are illustrative of several aspects of the invention.

EXAMPLE I.

Two samples (Samples A & B) of silicon steel were cast and processed into silicon steel having a cube-on-edge orientation from a heat of silicon steel. The chemistry of the heat appears hereinbelow in Table I. 1

TABLE I

| Composition (wt. %) | | | | | | | | |
|---|---|---|---|---|---|---|---|---|
| C | Mn | S | B | N | Si | Cu | Al | Fe |
| 0.03 | 0.035 | 0.031 | 0.0010 | 0.0050 | 3.15 | 0.24 | 0.005 | Bal. |

Processing for the samples involved soaking at an elevated temperature for several hours, hot rolling to a gage of from 80 to 100 mils, annealing at 1650° F, cold rolling to a gage of approximately 60 mils, annealing at a temperature of 1740° F, cold rolling to a gage of 10.8 mils, decarburizing at a temperature of 1475° F in a hydrogen atmosphere, and final annealing at a maximum temperature of 2150° F in hydrogen. The dew point of the hydrogen decarburizing atmosphere was maintained at +80° F for Sample A and at +30° F for Sample B.

Samples A and B were tested for permeability and core loss. The results of the tests appear hereinbelow in Table II.

TABLE II

| Sample | Core Loss (WPP at 17 KB) | Permeability (at 10 $O_e$) |
|---|---|---|
| A | 0.720 | 1853 |
| B | 0.679 | 1889 |

From Table II, it is clear that the processing of the present invention is highly beneficial to the properties of silicon steel having a cube-on-edge orientation. An improvement is seen in both core loss and permeability when the dew point of the hydrogen is decreased from +80° F (Sample A) to +30° F (Sample B). Note that the core loss of Sample B is 0.679 watts per pound whereas that for Sample A is considerably higher at 0.720.

EXAMPLE II.

A third sample (Sample C) was cast and processed into silicon steel in the same manner as were Samples A and B, with the exception that it was decarburized in an 80% nitrogen – 20% hydrogen atmosphere having a dew point of +30° F. The chemistry of Sample C is the same as that of Samples A and B.

Sample C was tested for permeability and core loss. The results of the tests appear hereinbelow in Table III.

TABLE III

| Sample | Core Loss (WPP at 17 KB) | Permeability (at 10 $O_e$) |
|---|---|---|
| C | 0.679 | 1874 |

Table III clearly shows that the subject invention is adaptable to the use of an atmosphere consisting essentially of nitrogen and hydrogen. In fact, the properties attained with the nitrogen-hydrogen atmosphere appear to be quite comparable to that obtained with the hydrogen atmosphere (See Sample B, Table II).

EXAMPLE III.

Four groupings of four samples (Samples $D_1$ through $D_4$, $E_1$ through $E_4$, $F_1$ through $F_4$ and $G_1$ through $G_4$) of silicon steel were cast and processed into silicon steel having a cube-on-edge orientation from a heat of silicon steel. The chemistry of the heat appears hereinbelow in Table IV.

TABLE IV

| Composition (wt. %) | | | | | | | | |
|---|---|---|---|---|---|---|---|---|
| C | Mn | S | B | N | Si | Cu | Al | Fe |
| 0.031 | 0.032 | 0.030 | 0.0011 | 0.0048 | 3.18 | 0.21 | 0.004 | Bal. |

Processing for the samples was the same as that in Example I, with the exception for the dew point of the decarburizing atmosphere. Samples $D_1$, $E_1$, $F_1$ and $G_1$ were decarburized in a hydrogen atmosphere having a dew point of +25° F. The atmospheric dew point for Samples $D_2$, $E_2$, $F_2$ and $G_2$ was +35° F. That for Samples $D_3$, $E_3$, $F_3$ and $G_3$ and Samples $D_4$, $E_4$, $F_4$ and $G_4$ was respectively +50° F and +70° F.

The samples were tested for permeability and core loss. The results of the tests appear hereinbelow in Table V. Also shown therein is the carbon content of the sample after decarburization.

TABLE V

| Sample | Dew Point (° F) | Carbon (%) | Core Loss (WPP at 17KB) | Permeability (at 10 $O_e$) |
|---|---|---|---|---|
| $D_1$ | +25 | 0.018 | 0.649 | 1872 |
| $D_2$ | +35 | 0.019 | 0.645 | 1869 |
| $D_3$ | +50 | 0.016 | 0.621 | 1870 |
| $D_4$ | +70 | 0.004 | 0.676 | 1848 |
| $E_1$ | +25 | 0.021 | 0.605 | 1886 |
| $E_2$ | +35 | 0.018 | 0.622 | 1874 |
| $E_3$ | +50 | 0.016 | 0.626 | 1875 |
| $E_4$ | +70 | 0.006 | 0.659 | 1858 |
| $F_1$ | +25 | 0.019 | 0.594 | 1877 |
| $F_2$ | +35 | 0.016 | 0.590 | 1886 |
| $F_3$ | +50 | 0.013 | 0.642 | 1864 |
| $F_4$ | +70 | 0.002 | 0.691 | 1838 |
| $G_1$ | +25 | 0.015 | 0.608 | 1882 |
| $G_2$ | +35 | 0.015 | 0.606 | 1890 |
| $G_3$ | +50 | 0.010 | 0.641 | 1869 |

TABLE V-continued

| Sample | Dew Point (° F) | Carbon (%) | Core Loss (WPP at 17KB) | Permeability (at 10 $O_e$) |
|---|---|---|---|---|
| $G_4$ | +70 | 0.004 | 0.676 | 1845 |

Table V once again demonstrates how the processing of the present invention is highly beneficial. An improvement is seen in both core loss and permeability when the dew point of hydrogen is decreased from +70° F to levels below +60° F. Also notable from Table V is how the improvement in properties levels off at dew points of +25° F, and how the maximum improvement in properties occurs at dew points of +35° F. The minimum dew point employed by the subject invention, as noted hereinabove, is +20° F. Also, as noted hereinabove, dew points of from +30° F to +45° F are preferred.

The values listed in Table V give the carbon content of the samples after decarburization; and clearly indicate that less carbon is removed as the atmosphere becomes drier. This is to be expected as decarburization requires oxygen, and in this operation, oxygen is supplied through moisture.

EXAMPLE IV.

Two samples (Samples H and I) of silicon steel were cast and processed into silicon steel in basically the same manner as were Samples A and B. Sample H was decarburized in a hydrogen atmosphere having a dew point of +70° F. Sample I was decarburized in a hydrogen atmosphere having a dew point of +30° F. The chemistry of Samples H and I appears hereinbelow in Table VI.

TABLE VI

| Composition (wt. %) | | | | | | | | |
|---|---|---|---|---|---|---|---|---|
| C | Mn | S | B | N | Si | Cu | Al | Fe |
| 0.022 | 0.039 | 0.030 | 0.0003 | <0.0100 | 3.0 | 0.19 | 0.005 | Bal. |

Note that the samples had only 0.0003% boron.

Samples H and I were tested for permeability and core loss. The results of the tests appear hereinbelow in Table VII.

TABLE VII.

| Sample | Core Loss (WPP at 17 KB) | Permeability (at 10 $O_e$) |
|---|---|---|
| H | 0.672 | 1855 |
| I | 0.672 | 1872 |

From Table VII, it is noted that the core loss remained the same when the dew point of hydrogen was reduced from +70° F (Sample H) to +30° F (Sample I). Significantly, Samples H and I had only residual boron; and as noted hereinabove, the improvement in magnetic properties attributable to the drier atmosphere of the subject invention is not evident in boron-free steels (steels containing only residual boron).

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing boron-bearing, electromagnetic silicon steel having a cube-on-edge orientation, which process includes the steps of: preparing a melt of silicon steel containing from 0.02 to 0.06% carbon, from 0.0006 to 0.0080% boron, up to 0.0100% nitrogen and from 2.5 to 4.0% silicon; casting said steel; hot rolling said steel; cold rolling said steel; decarburizing said steel; and final texture annealing said steel; the improvement comprising the step of decarburizing said steel to a carbon level below 0.02% in a hydrogen bearing atmosphere having a controlled dew point of from +20° F to +60° F, said controlled dew point selected to yield a decrease in said steel's core loss.

2. An improvement according to claim 1, wherein said steel is decarburized in a hydrogen-bearing atmosphere having a dew point of from +30° F to +45° F.

3. An improvement according to claim 1, wherein said hydrogen-bearing atmosphere consists essentially of hydrogen.

4. An improvement according to claim 1, wherein said melt consists essentially of, by weight, 0.02 to 0.06% carbon, 0.015 to 0.11% manganese, 0.015 to 0.05% sulfur, 0.0006 to 0.0080% boron, up to 0.0100% nitrogen, 2.5 to 4.0% silicon, up to 0.5% copper, up to 0.008% aluminum, balance iron.

5. An improvement according to claim 1, wherein said hydrogen-bearing atmosphere consists essentially of hydrogen and nitrogen.

* * * * *